United States Patent [19]

Saito

[11] Patent Number: 4,920,526

[45] Date of Patent: Apr. 24, 1990

[54] TIMEPIECE ASSEMBLY INCLUDING SHEET WITH WRISTWATCH REMOVABLE THEREFROM

[75] Inventor: Yasuhiko Saito, Tokyo, Japan

[73] Assignee: Sony Creative Products Incorporation, Tokyo, Japan

[21] Appl. No.: 232,603

[22] Filed: Aug. 15, 1988

[30] Foreign Application Priority Data

Feb. 10, 1988 [JP] Japan ..... 63-16746[U]

[51] Int. Cl.[5] ..... G04B 37/00

[52] U.S. Cl. ..... 368/281; 368/223; 368/282

[58] Field of Search ..... 368/282, 283, 276, 316, 368/317

[56] References Cited

U.S. PATENT DOCUMENTS

| | | | |
|---|---|---|---|
| 4,155,219 | 5/1979 | Anderson | 368/283 |
| 4,509,644 | 4/1985 | Kulick | 368/283 |
| 4,779,249 | 10/1988 | Rapport | 368/276 |

FOREIGN PATENT DOCUMENTS

| | | | |
|---|---|---|---|
| 2626546 | 12/1977 | Fed. Rep. of Germany | 368/282 |
| 51485 | 4/1910 | Switzerland | 368/316 |
| 143076 | 10/1930 | Switzerland | 368/316 |
| 284896 | 2/1928 | United Kingdom | 368/316 |

*Primary Examiner*—Bernard Roskoski

*Attorney, Agent, or Firm*—Wenderoth, Lind & Ponack

[57] ABSTRACT

A timepiece composed of a sheet on the surface of which any suitable patterns or characters can be printed, and a timepiece driving section fixed to the back of the sheet, said sheet having a cut out section the contour of which substantially corresponds to that of a time display section of said timepiece driving section. Various designs can simply be applied to the sheet of said timepiece through a printing process. On the other hand, when said sheet is shaped or cut off into a certain configuration, the resulting timepiece can be used in various applications such as wrist watch, table-clock, wall-clock and the like.

13 Claims, 3 Drawing Sheets

TIMEPIECE ASSEMBLY INCLUDING SHEET WITH WRISTWATCH REMOVABLE THEREFROM

BACKGROUND OF THE INVENTION

1. Field of the Invention

The present invention relates to a wristwatch, table clock and other types of a timepiece to which any suitable design can be freely applied and which can be employed for a wide variety of uses and which can be produced inexpensively.

2. Description of the Prior Art

A conventional timepiece, for example, a wristwatch, includes a timepiece driving section (movement) including a dial plate, a liquid crystal display or the like, a band, and a band fastener. Crystal oscillation and liquid crystal display techniques are utilized in such a movement, so that the design of the dial plate increasingly becomes lighter and thinner. The arrangement of displays and the like vary in accordance with fashion. The materials of wristwatch bands are selected from metal, leather, rubber, plastics and the like, and these materials are provided in various designs in accordance with fashion.

However, conventional timepieces such as wristwatches, table clocks, wall clocks have only limited numbers of respective configurations. Furthermore, their designs are limited to a certain extent by the types of materials employed for wristwatch bands and frames. When attempts are made to provide new such designs, there arises the problem of increased cost. In the case of selling timepieces in a shop, there is the additional problem that separate types and designs of timepieces must be exhibited, so that considerable space is required for such exhibition.

SUMMARY OF THE INVENTION

Accordingly, an object of the present invention is to provide a timepiece which freely may be provided in any suitable design but at a relatively inexpensive cost.

It is another object of the present invention to provide a timepiece for which various applications can be selected by an user.

It is still another object of the present invention to provide a timepiece, wherein the space required for exhibition thereof in a shop is reduced, and at the same time which has a shape that is advantageous for achieving advertising effects.

In the present invention, the above described objects are attained by the provision of a timepiece including a sheet on the surface of which any suitable patterns or characters can be printed, and a timepiece driving section fixed to a back of the sheet. The sheet has a cut out section the contour of which substantially corresponds to that of a time display section of the timepiece driving section.

With a timepiece according to the above described construction, various patterns, for example, designs of wristwatch and wristwatch band, designs of a wall clock and the like designs inexpensively can be applied to the surface of the sheet by a printing process. Moreover, the timepiece of the present invention is completed merely by a process such as bonding a timepiece driving section (movement) to the back of the sheet by means of an adhesive or the like. The sheet itself can be cut into various configurations, so that it freely can be adopted to various applications.

DETAILED DESCRIPTION OF PREFERRED EMBODIMENT OF THE INVENTION

Figure 1A:
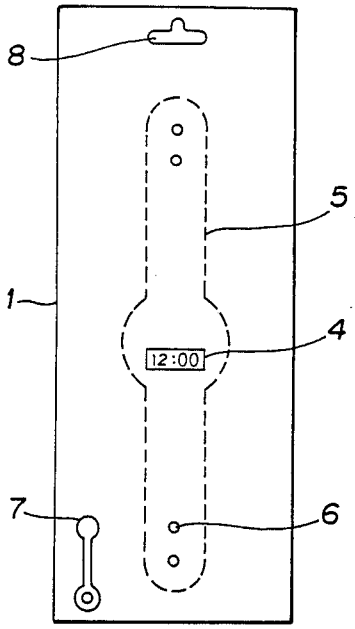
FIGS. 1(*a*)–(*e*) are front, rear, cross-sectional, perspective, and schematic views, respectively, showing an embodiment of the present invention.
Figure 1B:
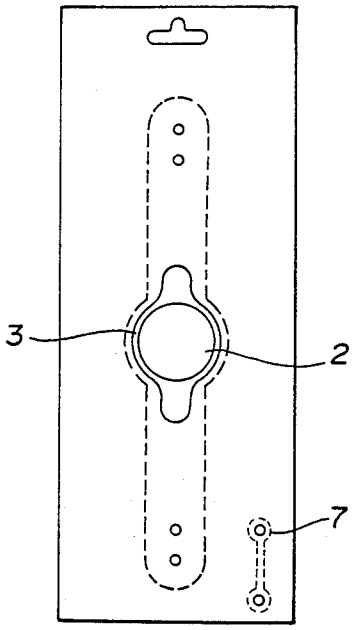
Figure 1C:
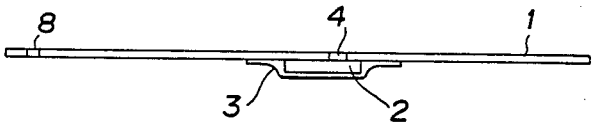
Figure 1D:
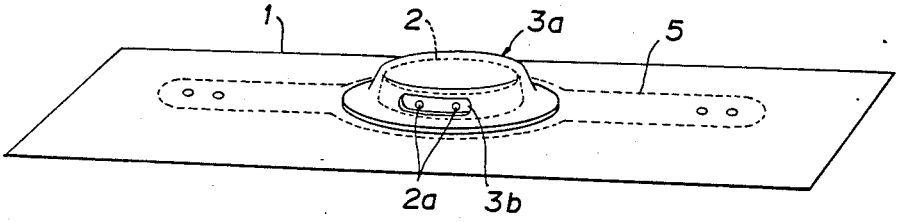
Figure 1E:
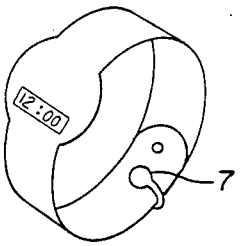

The timepiece according to the present invention will be described in detail hereinbelow. FIGS. 1(*a*)–(*e*) illustrate a first embodiment of the timepiece according to the present invention which includes a sheet 1 made of a material on the surface of which any suitable patterns or characters may be printed, for example, paper, composite sheet prepared by laminating a paper with a plastic film such as polyvinyl film or the like, or made of printable plastics or cloth or the like; a clock movement 2 (clock driving section having a frame body) provided with a liquid crystal display (LCD) or the like, and a tape 3 which functions to fix movement 2 onto sheet 1.

The sheet 1 has a display window 4 formed in the area of sheet 1 corresponding to the liquid crystal display of the movement 2, a perforated line 5 defining the shape of a watchband that is removable from sheet 1 and that has thereon the movement 2, holes 6 within the wristwatch band, and an opening 8 used in case of exhibition or the like. In addition, the sheet 1 has attached thereto a fastener 7 made from a material such as plastics or the like.

Instead of the tape 3, the movement 2 may be bonded directly to the sheet 1 by the use of an adhesive, or the movement 2 may be subjected to a shrink packaging operation together with the sheet 1 by the use of a plastic film, whereby they can be fixed together.

Further, the movement may be fixed to the sheet 1 by means of a hat-shaped or dish-shaped plastic cover 3*a* as shown in FIG. 1(*d*). In this case, the plastic cover 3*a* is secured to the sheet 1 by an adhesive placed on the edge portion thereof or by adhesive tape. Furthermore, a hole 3*b* for operating adjusting buttons 2*a* of the movement and through which time, date and the like are adjusted may be defined in the plastic cover 3*a*. Still another opening for exchanging a mercury battery which is used for the movement 2 may also be defined in cover 3*a*.

Also, a magic tape or the like may be used for fixing a wristwatch band in place of holes 6 or the fastener 7.

Yet further, the movement 2 may be of the type wherein the time indication is effected by hands rather than by a liquid crystal display. In such case the display window 4 would have a shape corresponding to that of a dial face.

When the timepiece according to the present invention having the above construction is cut off or otherwise removed along the perforated line 5 and the wristwatch band holes 6 are superposed on one another and engaged by means of the fastener 7, the finished timepiece is utilized as a wristwatch. In this connection, the shapes defined by the perforated line 5 may be modified for various applications of the timepiece as a table clock, wall clock or the like.

In the present embodiment, a variety of designs or other indicia easily can be applied to the surface of the sheet 1 by printing, so that the present invention has the advantage of reducing costs compared to conventional timepieces. In the case where no pattern nor character has been printed on the sheet 1, a consumer can use such timepiece after applying freely any suitable design to the sheet 1 by him- or herself.

When timepieces according to the present invention are exhibited on a shelf, wall or the like by suspending the timepieces themselves, e.g. by use of the opening 8 defined in each of them, the space required for such exhibition can be reduced, while at the same time an advertising effect can be achieved.

Figure 2:
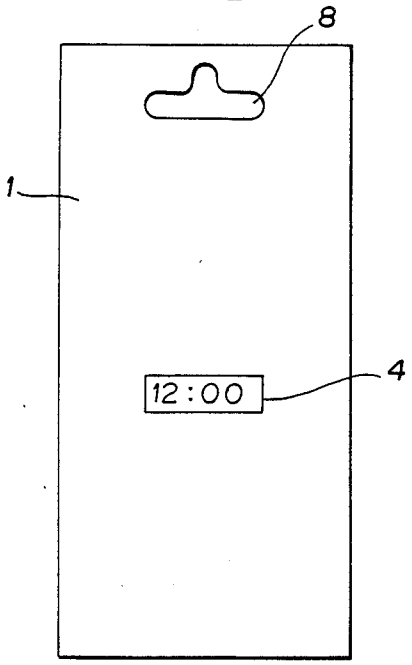
FIG. 2 is a front view showing an embodiment of the present invention.

FIG. 2 illustrates the timepiece according to a second embodiment of the present invention that includes a sheet 1, a movement 2 and a tape 3, but does not include a perforated line or notch 5. Accordingly, a consumer can use such timepiece either as a wall clock by hanging it on a hook or the like by means of opening 8 defined on the sheet 1 with the use of the entire surface of the timepiece (which has been either printed or not printed) without any modification, or as a wristwatch, a table clock or the like by cutting the sheet 1 into any suitable shape including the movement 2.

Figure 3A:
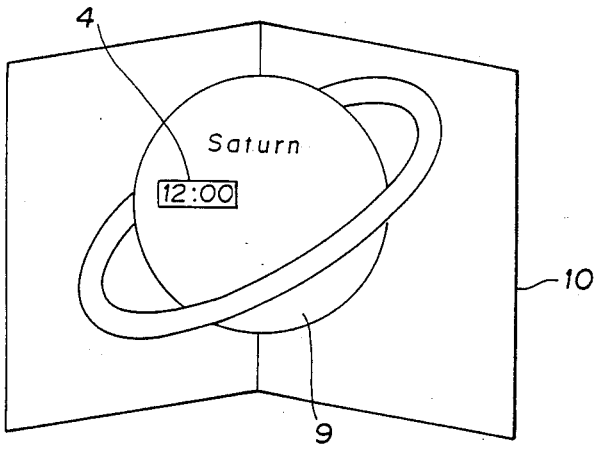
FIGS. 3(*a*) and (*b*) are schematic views showing embodiments of the present invention.
Figure 3B:
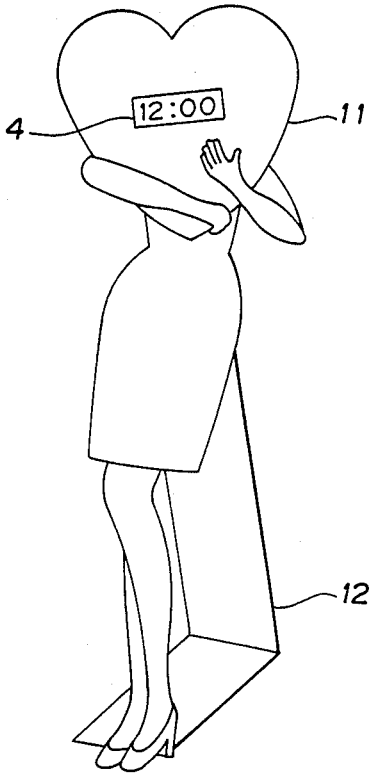

FIGS. 3(*a*) and (*b*) illustrate the third embodiment according to the present invention. FIG. 3(*a*) shows a card such as a folded Christmas card or the like which is composed of Saturn-shaped sheet 9 on which is defined a time display window 4 and onto the back of which a movement is bonded by means of an adhesive or the like, and a cardboard 10 within which is inserted sheet 9 to be attached thereto. On the other hand, FIG. 3(*b*) shows a woman figure-shaped ornament which is composed of a sheet 11 on which is defined a time display window 4 and onto the back of which a movement is bonded by means of an adhesive or the like, and a supporting member 12 for supporting sheet 11.

In the card shown in FIG. 3(*a*), when the cardboard 10 is opened, the sheet 9 is held on the surface of the cardboard 10 in the Saturn shape in three dimensions.

The card shown in FIG. 3(*a*) and the ornament shown in FIG. 3(*b*) are examples wherein various designs such as Saturn, figure of woman and the like are utilized, so that the sheets 9 and 11 each provided with a time display section are expanded to uses other than those of a conventional timepiece.

I claim:

1. A timepiece assembly that easily can be displayed by a merchant and that then may be converted into a wristwatch by a customer, said assembly comprising:

a sheet of a material that is suitable for forming a wristwatch band;

a timepiece movement fixed to a rear surface of said sheet, said timepiece movement having a time display section;

said sheet having formed therethrough an opening at a position and of a shape corresponding to said time display section; and means defining on said sheet an outline of a shape suitable for use, upon removal of said shape from said sheet, as a wristwatch and an integral wristwatch band, said outline encompassing said opening and that area of said sheet to which is fixed said timepiece movement;

whereby, upon removal by a customer of said shape from said sheet, said removed shape having fixed thereto said timepiece movement may be employed by the customer as a wristwatch.

2. An assembly as claimed in claim 1, wherein said sheet has therethrough, at a position outwardly of said outline, an opening enabling said assembly to be displayed by a merchant.

3. An assembly as claimed in claim 1, wherein said shape has opposite ends, and further comprising means for, upon removal of said shape from said sheet, joining said opposite ends as ends of the wristwatch band.

4. An assembly as claimed in claim 3, wherein said joining means comprises holes through said opposite ends, and a fastener attached to said sheet and operable for, upon removal from said sheet, insertion through said holes to thus connect said opposite ends.

5. An assembly as claimed in claim 1, wherein said outline defining means comprises at least one line of perforations formed in said sheet.

6. An assembly as claimed in claim 1, wherein said sheet is formed of a paper material.

7. An assembly as claimed in claim 1, wherein said sheet is formed of a plastic material.

8. An assembly as claimed in claim 1, wherein said sheet is formed of a laminate of paper and plastic.

9. An assembly as claimed in claim 1, wherein said sheet is formed of a cloth material.

10. An assembly as claimed in claim 1, wherein said sheet is formed of a material capable of having indicia printed thereon.

11. An assembly as claimed in claim 1, wherein said timepiece movement is fixed to said sheet by an adhesive.

12. An assembly as claimed in claim 1, wherein said timepiece movement is fixed to said sheet by adhesive tape.

13. An assembly as claimed in claim 1, wherein said timepiece movement is fixed to said sheet by a plastic cover.

* * * * *